US007444108B2

(12) United States Patent
Moore et al.

(10) Patent No.: US 7,444,108 B2
(45) Date of Patent: Oct. 28, 2008

(54) PARALLEL PRINTING ARCHITECTURE WITH PARALLEL HORIZONTAL PRINTING MODULES

(75) Inventors: Steven R. Moore, Rochester, NY (US); Barry P. Mandel, Fairport, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 452 days.

(21) Appl. No.: 11/094,998

(22) Filed: Mar. 31, 2005

(65) Prior Publication Data

US 2006/0221159 A1 Oct. 5, 2006

(51) Int. Cl.
*G03G 15/00* (2006.01)
*B65H 85/00* (2006.01)

(52) U.S. Cl. ..... 399/381; 399/361

(58) Field of Classification Search ..... *B65H 85/00*
See application file for complete search history.

(56) References Cited

U.S. PATENT DOCUMENTS 4,579,466 A 4/1986 Sato
4,587,532 A 5/1986 Asano
4,836,119 A 6/1989 Siraco
4,972,236 A 11/1990 Hasegawa
5,080,340 A 1/1992 Hacknauer
5,095,342 A 3/1992 Farrell
5,159,395 A 10/1992 Farrell
5,208,640 A 5/1993 Horie
5,272,511 A 12/1993 Conrad
5,326,093 A 7/1994 Sollitt
5,389,969 A 2/1995 Suzuki
5,435,544 A 7/1995 Mandel
5,473,419 A 12/1995 Russel (Continued)

FOREIGN PATENT DOCUMENTS

EP 1 625 942 A 2/2006

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Jill E. Culler
*Assistant Examiner*—Wyn' Q Ha
(74) *Attorney, Agent, or Firm*—Fay Sharpe LLP

(57) ABSTRACT

An intergrated printing system is provided that includes at least two substantially horizontally aligned printing modules including an entrance media path and an exit media path; and at least one interface media transport including at least two substantially horizontal media transport paths, wherein the horizontal media transport paths are positioned vertically relative to each other to provide upper and lower horizontal media transport paths and the horizontal media transport paths transport paths are positioned vertically relative to each other to provide upper and lower horizontal media transport paths and the horizontal media transport paths transport media to the horizontally aligned printing module. The integrated printing system also provides for a horizontal media transport path to transport media to the horizontally aligned printing module in a direction that passes the exit path of one of the horizontally aligned printing modules before passing the entrance media path of the other printing module.

13 Claims, 8 Drawing Sheets

U.S. PATENT DOCUMENTS

| | | | | |
|---|---|---|---|---|
| 5,504,568 | A | 4/1996 | Saraswat | |
| 5,525,031 | A | 6/1996 | Fox | |
| 5,557,367 | A | 9/1996 | Yang | |
| 5,568,246 | A | 10/1996 | Keller | |
| 5,570,172 | A | 10/1996 | Acquaviva | |
| 5,596,416 | A | 1/1997 | Barry | |
| 5,629,762 | A | 5/1997 | Mahoney | |
| 5,678,138 | A * | 10/1997 | Kobayashi et al. | 399/18 |
| 5,710,968 | A | 1/1998 | Clark | |
| 5,778,377 | A | 7/1998 | Marlin | |
| 5,884,910 | A | 3/1999 | Mandel | |
| 5,995,721 | A | 11/1999 | Rourke | |
| 6,059,284 | A | 5/2000 | Wolf | |
| 6,125,248 | A | 9/2000 | Moser | |
| 6,212,357 | B1 | 4/2001 | Boehmer et al. | |
| 6,241,242 | B1 | 6/2001 | Munro | |
| 6,297,886 | B1 | 10/2001 | Cornell | |
| 6,384,918 | B1 | 5/2002 | Hubble, III | |
| 6,450,711 | B1 | 9/2002 | Conrow | |
| 6,476,376 | B1 | 11/2002 | Biegelsen | |
| 6,476,923 | B1 | 11/2002 | Cornell | |
| 6,493,098 | B1 | 12/2002 | Cornell | |
| 6,537,910 | B1 | 3/2003 | Burke | |
| 6,550,762 | B2 | 4/2003 | Stoll | |
| 6,554,276 | B2 | 4/2003 | Jackson | |
| 6,577,925 | B1 | 6/2003 | Fromherz | |
| 6,607,320 | B2 | 8/2003 | Bobrow | |
| 6,608,988 | B2 * | 8/2003 | Conrow | 399/364 |
| 6,612,566 | B2 | 9/2003 | Stoll | |
| 6,621,576 | B2 | 9/2003 | Tandon | |
| 6,633,382 | B2 | 10/2003 | Hubble, III | |
| 6,639,669 | B2 | 10/2003 | Hubble, III | |
| 6,819,906 | B1 | 11/2004 | Herrmann | |
| 7,010,242 | B2 * | 3/2006 | Suzuki et al. | 399/110 |
| 7,136,616 | B2 * | 11/2006 | Mandel et al. | 399/388 |
| 7,188,929 | B2 * | 3/2007 | Lofthus | 347/40 |
| 7,206,536 | B2 * | 4/2007 | Julien | 399/110 |
| 2002/0078012 | A1 | 6/2002 | Ryan | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz | |
| 2004/0150158 | A1 | 8/2004 | Biegelsen | |
| 2004/0153983 | A1 | 8/2004 | McMillan | |
| 2004/0216002 | A1 | 10/2004 | Fromherz | |
| 2004/0225391 | A1 | 11/2004 | Fromherz | |
| 2004/0225394 | A1 | 11/2004 | Fromherz | |

FOREIGN PATENT DOCUMENTS

| | | | |
|---|---|---|---|
| JP | 59 171965 | A | 9/1984 |
| JP | 06 340137 | A | 12/1994 |
| JP | 10086455 | A * | 4/1998 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/860,195, filed Aug. 23, 2004, Lofthus et al.
U.S. Appl. No. 10/881,619, filed Jun. 20, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.

* cited by examiner

PARALLEL PRINTING ARCHITECTURE WITH PARALLEL HORIZONTAL PRINTING MODULES

The following applications, the disclosures of each being totally incorporated herein by reference are mentioned:

U.S. Provisional Application Ser. No. 60/631,651 , filed Nov. 30, 2004,entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918 , filed Nov. 30, 2004,entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921 , filed Nov. 30, 2004,entitled "PRINTING SYSTEM WITH MULTIPLE OPERATIONS FOR FINAL APPEARANCE AND PERMANENCE," by David G. Anderson et al.;

U.S. application Ser. No. 10/761,522 , filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211 , filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195 , filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619 , filed Jun. 30, 2004, entitled "FLEXIBLE PAPER PATH USING MULTIDIRECTIONAL PATH MODULES," by Daniel G. Bobrow.;

U.S. application Ser. No. 10/917,676 , filed Aug. 13,2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768 , filed Aug. 13, 2004, entitled "Parallel Printing Architecture Consisting of Containerized Image Marking ENGINES and Media feeder Modules," by Robert M. Lofthus, et al.;

U.S. application Ser. No. 10/924,106 , filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113 , filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458 , filed Aug. 23, 2004, entitled "PRINT SEQUENCE SCHEDULING FOR RELIABILITY," by Robert M. Lofthus, et al.;

U.S. patent application Ser. No. 10/924,459 , filed Aug. 23, 2004,entitled "Parallel Printing Architecture Using Image Marking device Modules," by Barry P. Mandel, et al;

U.S. patent application Ser. No. 10/933,556 , filed Sep. 3, 2004,entitled "SUBSTRATE INVERTER SYSTEMS AND METHODS," by Stan A. Spencer, et al.;

U.S. patent application Ser. No. 10/953,953 , filed Sep. 29, 2004,entitled "Customized Set Point Control For Output Stability In A TIPP Architecture," by Charles A. Radulski et al.;

U.S. application Ser. No. 10/999,326 , filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450 , filed Nov. 30, 2004,entitled "Addressable Fusing For An Integrated Printing System," by Robert M. Lofthus, et al.;

U.S. patent application Ser. No. 11/000,158 , filed Nov. 30, 2004,entitled "Glossing System For Use In A TIPP Architecture," by Bryan J. Roof;

U.S. patent application Ser. No. 11/000,168 , filed Nov. 30, 2004, entitled "Addressable Fusing and Heating Methods and Apparatus," by David K. Biegelsen, et al.;

U.S. patent application Ser. No. 11/000,258 , filed Nov. 30, 2004, entitled "Glossing System For Use In A TIPP Architecture," by Bryan J. Roof;

U.S. application Ser. No. 11/001,890 , filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528 , filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817 , filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681 , filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473 , filed Mar. 16, 2005, entitled "MULTI-PURPOSE MEDIA TRANSPORT HAVING INTEGRAL IMAGE QUALITY SENSING CAPABILITY," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled "IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien; and, U.S. application Ser. No. 11/095,872, filed Mar. 31, 2005,entitled "PRINTING SYSTEM," by Paul C. Julien.

BACKGROUND

The present disclosure relates to a plurality of printing or image recording apparatuses providing a multifunctional and expandable printing system. It finds particular application in conjunction with integrated printing modules consisting of several marking engines, each having the same or different printing capabilities, and will be described with particular reference thereto. However, it is to be appreciated that the present disclosure is also amenable to other like applications.

Various apparatuses for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

The marking engine of an electronic reprographic printing system is frequently an electrophotographic printing machine. In such a machine, a photoconductive belt is charged to a substantially uniform potential to sensitize the belt surface. The charged portion of the belt is thereafter selectively exposed. Exposure of the charged photoconductive belt or member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is subsequently transferred to a copy sheet. The copy sheet is heated to permanently affix the toner image thereto in image configuration.

Multi-color electrophotographic printing is substantially identical to the foregoing process of monochrome printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of monochrome printing, the copy sheet is advanced from an input tray to a path internal to the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, as one example, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Additionally, it is common practice to record images not only on one surface of the sheet, but also on both surfaces of a sheet. Copying or printing on both sides of a sheet decreases the number of sheets used from the viewpoint of saving of resources or filing space. In this regard as well, a system has been put into practical use whereby sheets having images recorded on a first surface thereof are once accumulated and after the recording on the first surface is completed, the accumulated sheets are then fed and images are recorded on a second surface thereof. However, this system is efficient when many sheets having a record of the same content are to be prepared, but is very inefficient when many sheets having different records on both surfaces thereof are to be prepared. That is, when pages 1, 2, 3, 4, . . .are to be prepared, odd pages, i.e. pages 1, 3, 5, . . .must first be recorded on the first surface of the respective sheets, and then these sheets must be fed again and even pages 2, 4, 6, . . .must be recorded on the second surface of the respective sheets. If, during the second feeding, multiplex feeding or jam of sheets should occur, the combination of the front and back pages may become mixed, thereby necessitating recording be done over again from the beginning. To avoid this, recording may be effected on each sheet in such a manner that the front and back surfaces of each sheet provide the front and back pages, respectively, but this takes time for the refeeding of sheets and the efficiency is reduced. Also, in the prior art methods, the conveyance route of sheets has been complicated and further, the conveyance route has unavoidably involved the step of reversing sheets, and this has led to extremely low reliability of sheet conveyance.

Also, there exist further requirements to record two types of information on one surface of a sheet in superposed relationship. Particularly, recently, coloring has advanced in various fields and there is also a desire to mix, for example, color print with monochrome print on one surface of a sheet. As a simple method for effecting a superposed relationship, there exists systems whereby recording is once effected in monochrome, whereafter the developing device in the apparatus is changed from a monochrome one to a color one, and recording is again effected on the same surface. This system requires an increase in time and labor.

Where two types of information are to be recorded on one surface of the same sheet in superposed relationship, sufficient care must be taken of the image position accuracy, otherwise the resultant copy may become very unsightly due to image misregistration or deviation from a predetermined image recording frame.

In recent years, the demand for even higher productivity and speed has been required of these image recording apparatuses. However, the respective systems have their own speed limits and if an attempt is made to provide higher speeds, numerous problems will occur and/or larger and more bulky apparatuses must be used to meet the higher speed demands. The larger and bulkier apparatuses, i.e. high speed printers, typically represent a very expensive and uneconomical apparatus. The expense of these apparatuses along with their inherent complexity can only be justified by the small percentage of extremely high volume printing customers.

BRIEF DESCRIPTION

In accordance with one aspect illustrated herein, a new and improved integrated printing system is provided. In one embodiment, the printing system includes an integrated printing system comprising at least one substantially horizontally aligned printing module including at least one entrance media path and at least one exit media path; and at least one interface media transport including at least two substantially horizontal media transport paths, wherein the at least two horizontal media transport paths are positioned vertically relative to each other to provide at least an upper and lower horizontal media transport path and the at least two horizontal media transport paths transport media to the at least one substantially horizontally aligned printing module.

According to another embodiment, an integrated printing system is provided including an integrated printing system comprising at least one substantially horizontally aligned printing module including at least one entrance media path and at least one exit media path; and at least one interface media transport including at least one substantially horizontal media transport path, wherein the horizontal media transport path transports media to said substantially horizontally aligned printing module in a direction that passes the at least one exit path before passing the at least one entrance media path.

According to another embodiment, an integrated printing system utilizing a xerographic imaging system is provided comprising a data source adapted for generating electronic image data and transmitting same to a plurality of printing modules; the plurality of printing modules including at least one substantially horizontally aligned printing module including an entrance media path and an exit media path; and at least one interface media transport including at least one substantially horizontal media transport path, wherein the horizontal media transport path transports media to the substantially horizontally aligned printing modules in a direction that passes the exit path before passing the entrance media path.

According to another embodiment, an integrated printing system is provided comprising a first array of at least one substantially horizontally aligned printing module including at least one entrance media path and at least one exit media path; a second array of at least one substantially horizontally aligned printing module including at least one entrance media path and at least one exit media path; and at least one interface media transport including at least one substantially horizontal media transport path, wherein the horizontal media transport path transports media to the horizontally aligned printing module in a direction that passes the said at least one exit path before passing the said at least one entrance path, and the first array and the second array are located substantially vertically to each other.

DETAILED DESCRIPTION

While the present printing apparatus and method will hereinafter be described in connection with exemplary embodiments, it will be understood that it is not intended to limit the embodiments. On the contrary, it is intended to cover all alternatives, modifications and equivalents as may be included within the spirit and scope of the embodiments as defined by the appended claims.

The embodiments, to be described below, include a plurality of printing modules. The printing modules can be, for example, any type of ink-jet printer, an electrophotographic printer, a thermal head printer that is used in conjunction with heat sensitive paper, or any other apparatus used to mark an image on a substrate. The printing modules can be, for example, black only (monochrome) and/or color printers. Examples of different varieties of color printers are shown in FIGS. 1-8, however monochrome printing modules and other varieties, types, alternatives, quantities, and combinations can be used within the scope of the embodiments illustrated herein. It is to be appreciated that, each of the printing modules can include an input/output interface, a memory, a marking cartridge platform, a marking driver, a function switch, a controller and a self-diagnostic unit, all of which can be interconnected by a data/control bus. Each of the printing modules can have a different processing speed capability.

Each printing module can be connected to a data source over a signal line or link. The data source provides data to be output by marking a receiving medium. In general, the data source can be any of a number of different sources, such as a scanner, a digital copier, a facsimile device that is suitable for generating electronic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. Thus, the data source can be any known or later developed source that is capable of providing scanned and/or synthetic data to each of the printing modules.

The link can be any known or later developed device or system for connecting the image data source to the printing modules, including a direct cable connection, a public switched telephone network, a wireless transmission channel, a connection over a wide area network or a local area network, a connection over an intranet, a connection over the internet, or a connection over any other distributed processing network or system. In general, the link can be any known or later developed connection system or structure usable to connect the data source to the printing modules. Further, it should be appreciated that the data source may be connected to the printing module directly.

Figure 1:
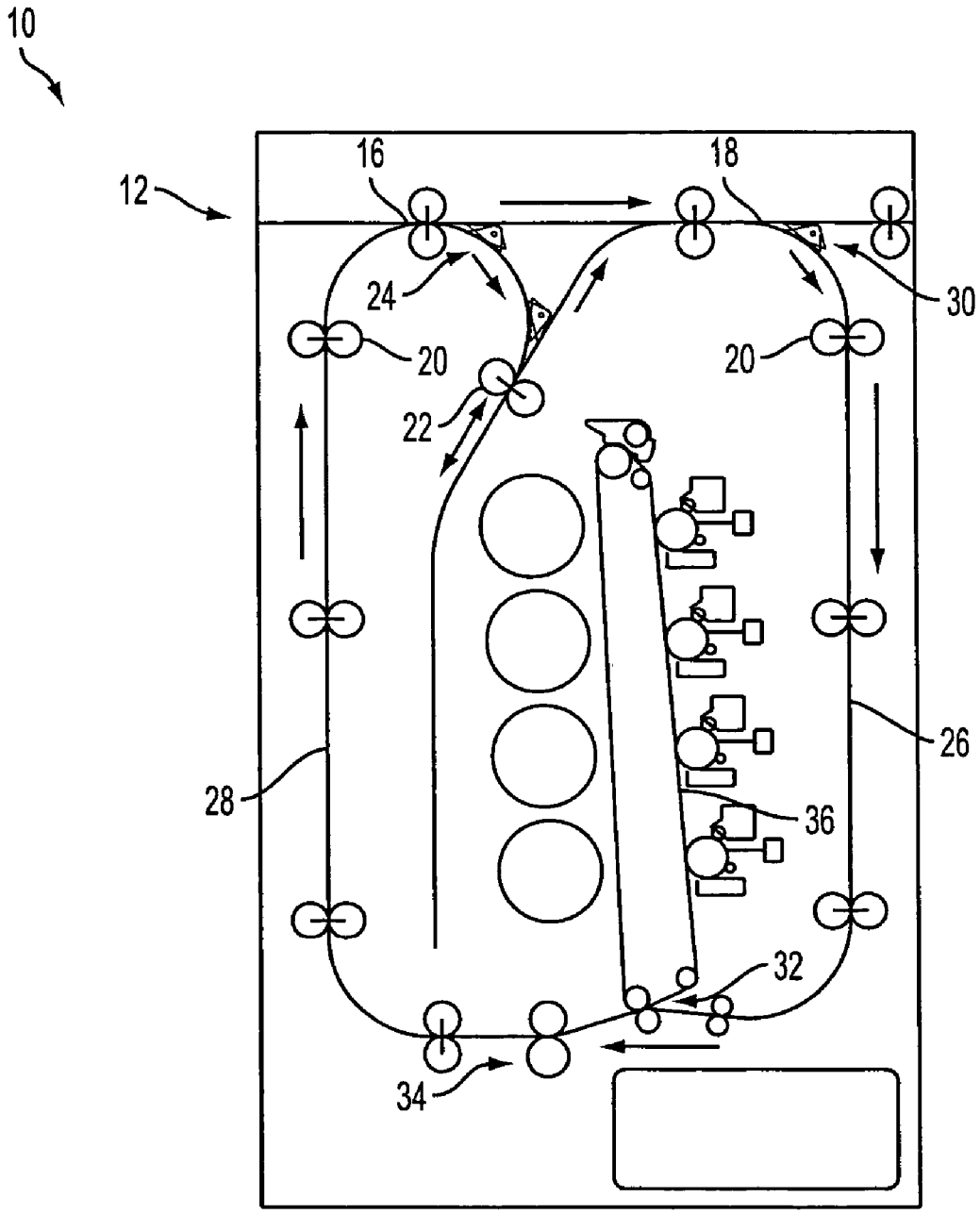
FIG. 1 is a sectional view showing a printing module.

Referring to FIG. 1, a printing module 10 is shown which employs a horizontal forward highway 12. The printing module 10 is configured as a clockwise flow printing module with a "clockwise flow" marking direction, as seen in FIG. 1. This allows sheets of media to enter the highway at a point 16 upstream of the marking path input connection 18. Thus, a sheet can be printed in two passes in immediate succession via the same printing module. In addition, this printing module configuration provides a simplex-only media path with a relatively short simple path structure. The vertical media transports 20 within the printing module are used to speed up/down media sheets that are entering/exiting the highway. A final printing module attribute is the generally vertical form factor, which minimizes the floor footprint of the system.

Each printing module has an integrated inverter 22 and inverter decision gate 24. The inverter 24 is positioned downstream of the marking path output point 16 and upstream of its input point 18. This location allows a sheet to be inverted before entering the marking input path 26 or after exiting the marking output path 28. In a system comprised of multiple printing modules, there are multiple inverters and planner/scheduler software has flexibility in routing sheets for a given job.

The printing module illustrated in FIG. 1 will now be described in more detail. A media sheet is transported to the forward highway 12, integrated within the printing module, via the forward highway from another attached printing module forward highway (not shown), an attached feeder module (not shown), or any other member (not shown) that provides sheets to the input of the forward highway 12. The media sheet travels on the forward highway path 12 to the marking path input decision gate 30 path where the media sheet can continue to travel on the forward highway path 12 to another member (not shown) or enter the input of the marking path 18 and proceed on the marking path input path 26 downstream of the marking path input decision gate 30. As illustrated, the media sheet next proceeds to the image marking process that includes an image transfer zone 32 and a fuser 34. Subsequent to the electrophotographic marking engine 36 marking a side of the media sheet, the sheet proceeds traveling on the marking exit path 28 towards the inverter decision gate 24. After the media sheet approaches the forward highway 12, the inverter decision gate 24 routes the sheet either onto the forward highway 12 in the direction of the marking path input decision gate 30 or routes the sheet to the inverter 22 where the sheet is inverted. Next the sheet is routed on the forward highway 12 in the direction of the marking path input decision gate 30. At this point the media sheet can be recirculated back into the marking path via the marking path input decision gate 30 for image marking, providing internal pass duplexing. Alternatively, the media sheet can continue to travel on the forward highway 12 to another printing module (not shown), finishing module (not shown) or other member that provides media sheet handling.

As shown in FIGS. 2-8 and to be described hereinafter, multiple printing modules are shown tightly coupled to or integrated with one another in a variety of configurations thereby enabling high speed printing and low run costs, with a high level of up time and system redundancy.

Figure 2:
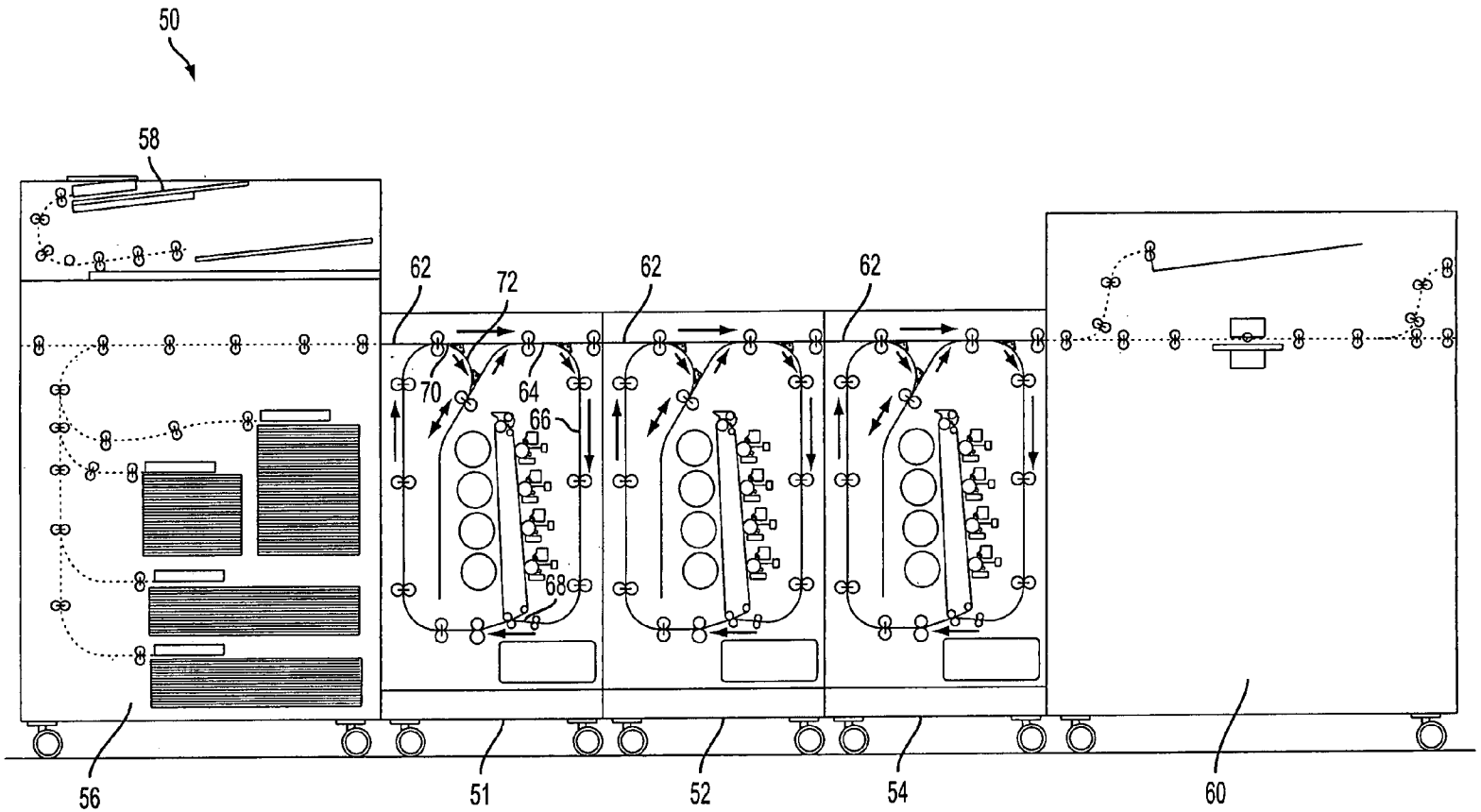
FIG. 2 is a sectional view showing a printing system according to a first embodiment.

Referring to FIG. 2, a printing system 50 having a modular architecture is shown which employs a horizontal frame structure that can hold at least two printing modules and provides horizontal media paths or transport highways. The modular architecture can alternatively include a separate frame structure around each printing module. The frame structure contains features to allow horizontal docking of the printing modules. The frame structure includes horizontal and vertical walls compatible with other printing modules. The two printing modules can be cascaded together with any number of other printing modules to generate higher speed configurations. It is to be appreciated that each printing module can be disconnected (i.e. for repair) from the printing system while the rest of the system retains its processing capability.

By way of example, an integrated printing system having three printing modules 51, 52 and 54 are shown in FIG. 2. The integrated printing system, as shown, further includes a paper/media feeding portion 56, a document scanner 58, and a paper/media finishing or exit portion 60. Between the feeding portion 56 and the finishing portion 60 are the three contained and integrated printing modules 51, 52 and 54. In FIG. 2, the printing modules shown can be monochrome printing modules, color printing modules or a combination of monochrome and color printing modules. It is to be appreciated that more and other combinations of color and monochrome printing modules can be utilized in any number of configurations.

In operation, media exits the feeding portion 56 onto the horizontal media highway 62 whereby the media enters the integrated printing module area. Although not shown, it is to be appreciated that feeding portion 56, or another feeding portion, could feed media directly to horizontal highway. The media can initially enter any one of printing modules 51, 52 and 54. If, for example, the media is to be processed through a monochrome only printing module on one side of the media, the paper can be delivered to a monochrome printing module which can be any one of the three printing modules shown. The media is transported by the horizontal highway 62.

With reference to one of the printing modules, namely printing module 51, the media paths are detailed below. The media originating from the feeding portion 56 enters horizontal highway 62. The media exits the horizontal highway at highway exit 64. Upon exiting the horizontal highway, the media travels along path 66 to enter the processing portion of the printing module at point 68 and is transported through a processing path of the printing module whereby the media receives an image. Next, the media exits the processing path at point 70 and can take alternate routes therefrom. Namely, the media can be recirculated, through an internal duplex loop 72 or towards the finishing module 60. Optionally, the media can be inverted by an inverter by way of path 72 and subsequently, exiting the inverter path to travel on the horizontal highway 62 to another printing module. The media can be moved from the initial printing module 51 to printing module 52 or 54 by way of the horizontal highway 62.

The architecture, described above, enables the use of multiple printing modules within the same system and can provide single pass duplexing, internal pass duplexing, and multi-pass printing. Single pass duplexing refers to a system in which side 1 of a sheet is printed with one printing module, and side 2 is printed with a second printing module instead of recirculating the sheet back into the first printing module. In contrast, internal pass duplexing refers to a system in which side 1 and side 2 are printed with a single printing module wherein the sheet is recirculated within the same printing module for printing of side 2.The single pass duplex media path, for example, enables duplexing to be accomplished by multiple printing modules. Alternatively, the internal duplex loops and paths enable duplex printing to continue within a single printing module, for example when one or more of the other printing modules are down for service prohibiting single pass duplexing. Multi-pass printing refers to a system in which side one of a sheet is printed with one printing module, and subsequently, a second printing module prints on the same side one.

In the configuration of FIG. 2, it is to be appreciated that single pass duplexing can be accomplished alternatively by two other printing modules 52 and 54. For example, printing modules 52 and 54, oriented substantially horizontally to one another, where the second printing module 54 is positioned downstream from the first or originating printing module 52.

The highways can be used to deliver sheets (media) to the printing modules and transport printed sheets away from the printing modules. As shown in FIG. 2, the horizontal highway 62 moves media from left to right (forward). The media highway also transports sheets between the printing modules 51, 52 and 54, and to the output devices 60. This process evens out the load on the highway, since blank sheets are leaving the highway, while printed sheets are joining the highway. The finishing module 60 can be used to provide multiple output locations as well as provide inverting and merging functions. As shown in FIG. 2, the directional movement of path 62 is substantially left to right from the feeding portion 56 to the finishing portion 60. It is to be appreciated that the horizontal path, or segments thereof, and connecting transport paths can intermittently reverse to allow for transport path routing changes of selected media. It is to be appreciated that the entire system can be mirror imaged and media moved in opposite directions.

The media traveling to the terminal ends of the horizontal highway enters the finishing module 60. The finishing module 60 collects or receives media from the highway 62 and delivers media in sequence to the media finishing device or portion. It is to be appreciated that the sheet entry and exit points are preferably at a standard height to permit use of existing, or standard, input/output modules. It is to be appreciated that the entire system can be mirror imaged and media moved in opposite directions.

Although not illustrated, it is to be appreciated that switches or dividing members are located at intersections along the horizontal highway and constructed so as to be switchable to allow sheets or media to move along one path or another depending on the desired route to be taken. The switches or dividing members can be electrically switchable between at least a first position and a second position. An enabler for reliable and productive system operation includes a centralized control system that has responsibility for planning and routing sheets, as well as controlling the switch positions, through the modules in order to execute a job stream.

Figure 3:
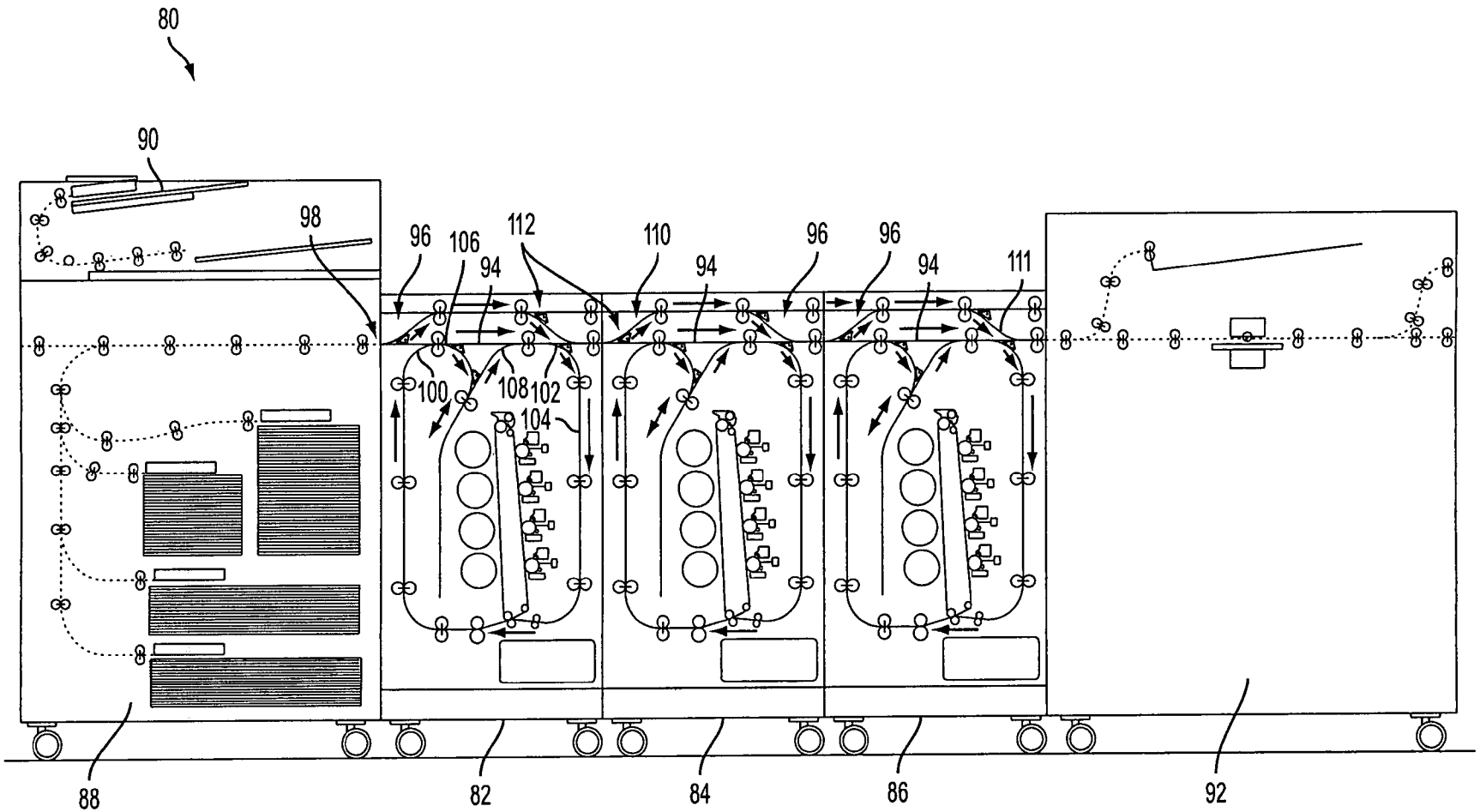
FIG. 3 is a sectional view showing a printing system according to a second embodiment.

The printing system described above can be integrated and expanded in a variety of configurations. By way of illustration, another printing system is shown in FIG. 3. The printing system 80 illustrates three printing modules, 82, 84 and 86, one media feed source 88, one document scanner 90, and one finishing/stacking portion 92. Media transport is by way of two substantially horizontal highways 94 and 96. In the configuration of FIG. 3, it is to be appreciated that single pass duplexing can be accomplished by alternative combinations of printing modules, for example, printing modules 82 and 84 oriented horizontally to one another, where printing module 84 is positioned downstream from the originating printing module 82.

The highways 94 and 96 can be used to deliver sheets (media) to printing modules 82, 84 and 86, and to transport sheets between printing modules 82, 84 and 86. Highways 94 and 96 can also transport printed sheets away from printing modules 82, 84 and 86 to the output finishing module 92. This process evens out the load on the highways, since blank sheets are leaving the highway while printed sheets are joining the highway.

The media paths of the printing modules engines are described in detail below. With reference to printing module 82, the media originating from the feeding portion 88, or printing module 82, enters the horizontal highway at point 98 or point 100, respectively. The media can exit the horizontal highway at a highway exit 102. Media enters the processing portion of printing module at point 102 and is transported along a processing path 104 of the printing module whereby the media receives an image. Next, the media exits the processing path at point 100 and can take alternate routes therefrom. Namely, the media can be recirculated, through an internal pass duplex loop, or can travel to the lower horizontal highway 94 for optionally entering another printing module or entering the upper horizontal highway 96 from the lower horizontal highway 94. If the media is moved back into the single pass duplex path portion, the media can be moved from the printing module to another printing module by way of path 108. If the media follows path 110 to the upper horizontal highway 96, the media can enter the finishing module 92 via path 111. The media alternatively can be recirculated back into printing module 82 by way of path 102. The control of access to and from the upper highway 96 is provided by decision gates 112 or other electronic switching.

The media traveling to the terminal ends of the horizontal highways enter the finishing module 92. The finishing module 92 collects or receives media from highway 94 and highway 96 via path 111, and delivers them in sequence to the media finishing device, stacker portion or delivers them directly to an output tray. These devices are either integrated into the finishing module 92 or accessible from the finishing module 92. It is to be appreciated that the modular architecture allows printing modules to be added and removed from a printing system.

Figure 4:
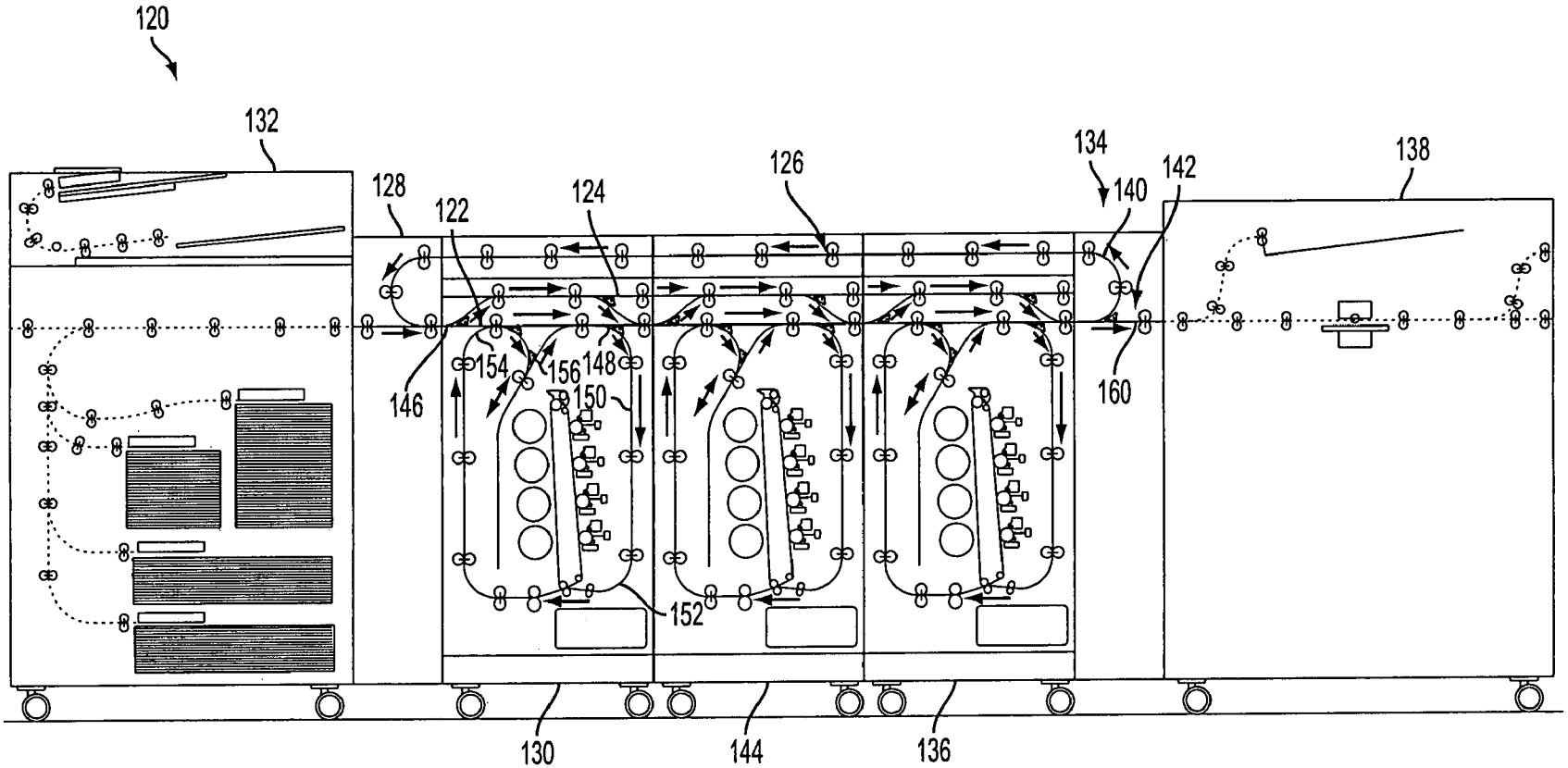
FIG. 4 is a sectional view showing a printing system according to a third embodiment.

Referring now to FIG. 4, another printing system 120 is therein illustrated. Illustrated are three substantially horizontal highways 122, 124 and 126 or media paths. As illustrated, an upper horizontal return highway 126 moves media from right to left, a middle horizontal forward highway 124 moves media from left to right and a lower horizontal forward highway 122 moves media from left to right. An input distributor module 128 positioned to the left of printing module 130 accepts sheets from a feeder module 132 and the upper horizontal return highway 126 and delivers them to the lower forward highway 122. An output distributor module 134 receives sheets from the lower forward highway 122 and delivers them in sequence to the finishing module 138 or recirculates the media by way of return path 140 controlled by a return highway decision gate 142.

An important capability shown in FIG. 4 is the ability of media to be first marked by any printing module and then marked again by any one or more subsequent printing modules to enable, for example, single pass duplexing and/or multi-pass printing. The members that enable this capability are the return highway 126 and the input and output distribution modules 128 and 134. The return highway is connected to, and extends between, both input and output distribution modules 128 and 134, allowing, for example, media to first be routed to the printing module 136, secondly along the output distributor module 142 return path, and thirdly along the upper return highway 126 to the input distributor module 128, and thence to the printing module 130 or printing module 144.

With reference to one of the printing modules, namely printing module 130, the media paths will be explained in detail below. The media originating from the input distributor module 128 can enter the lower horizontal forward highway 122 by way of path 146. The media can exit the lower horizontal highway at highway exit 148. Thereupon, the media enters the processing portion of printing module 130 via path 150 and is transported through a processing path 152 of the printing module whereby the media receives an image. Next, the media exits the processing path at point 154 and can take alternate routes therefrom. Namely, the media can enter the inverter 156 or can travel the lower horizontal highway 122. When all marking has been completed, media is delivered to the finishing module 138 by way of path 160.

Figure 5:
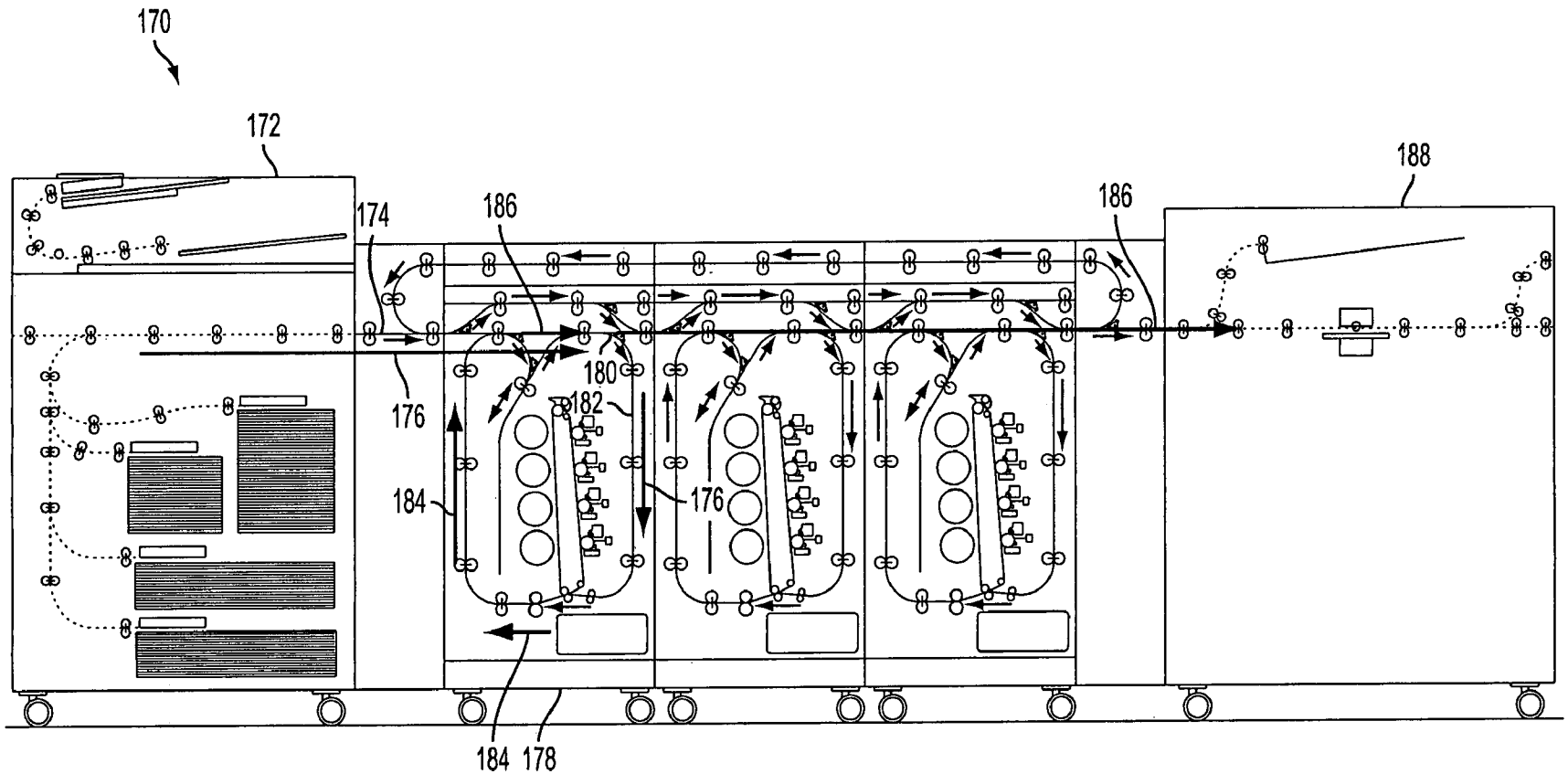
FIG. 5 is a sectional view showing a printing system according to the third embodiment, further illustrating a media path.

Referring to FIG. 5, illustrated is an example of simplex printing according to one embodiment 170 of this disclosure. The feeder module 172 feeds a blank media sheet to the lower horizontal highway 174 and the blank media sheet travels along the path indicated as 176. This includes travel along the lower horizontal highway 174 in the direction of printing module 178 input decision gate 180. After reaching the input decision gate 180, the blank media sheet travels into the printing module input marking path 182. The blank media sheet then travels through the image transfer zone where it becomes a printed media sheet. The printed media sheet then travels along the path 184 indicated to reach the lower horizontal highway 174. The printed media sheet is then transported along the lower horizontal highway 174 along path 186 to the finishing module 188.

Figure 6:
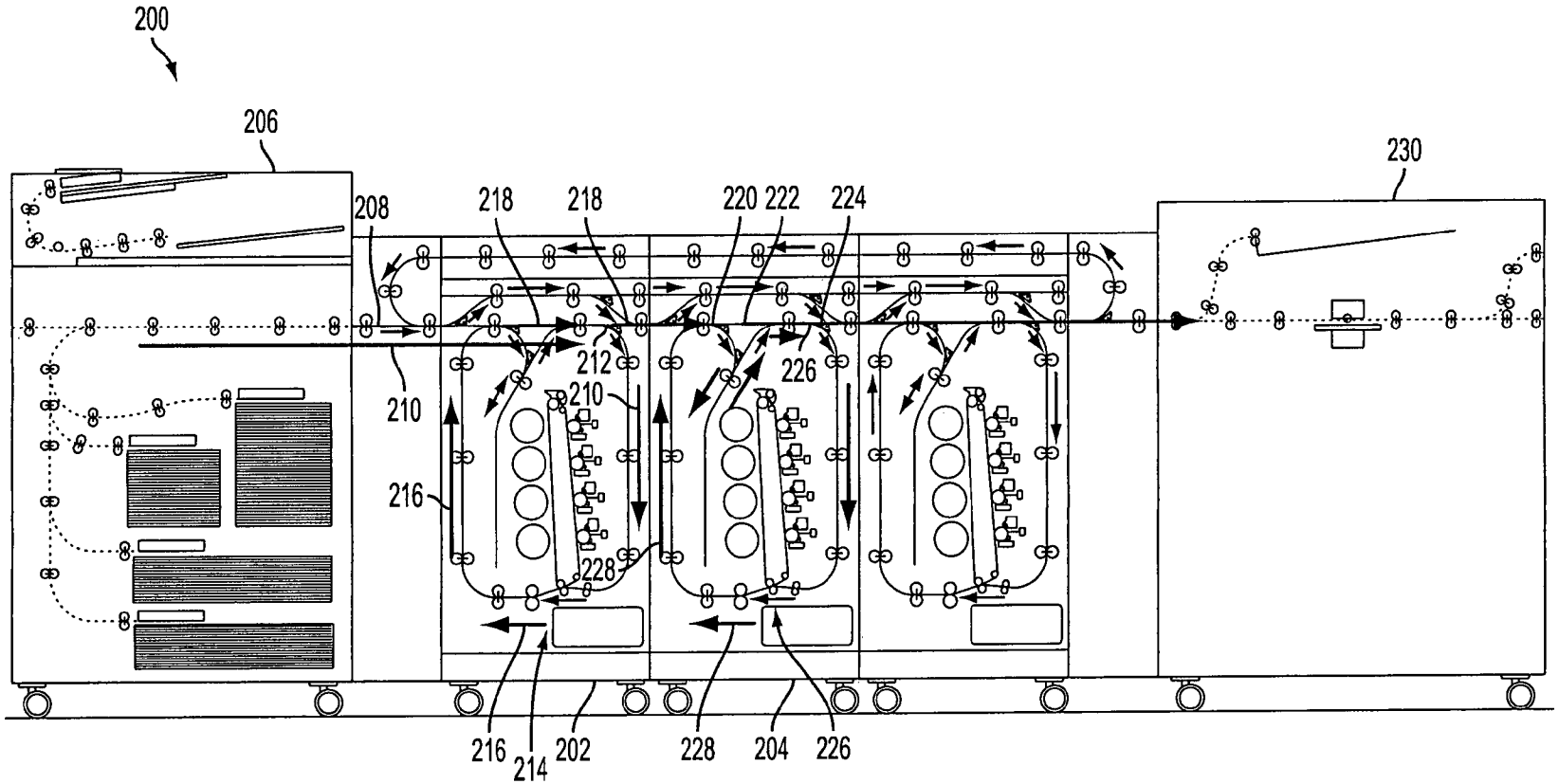
FIG. 6 is a sectional view showing a printing system according to the third embodiment, further illustrating another media path.

Referring to FIG. 6, illustrated is an example of a single pass duplex printing system 200 using two printing modules, 202 and 204. The feeder module 206 feeds a blank media sheet to the lower horizontal highway 208 and the blank media sheet travels along the path 210 indicated. This includes travel along the lower horizontal highway 208 in the direction of the input decision gate 212. After reaching the input decision gate 212, the blank media sheet travels onto marking path 210. The blank media sheet then travels through the image transfer zone 214 where it becomes a media sheet with print on side one. The one-sided printed media sheet then travels along the path 216 indicated to reach the lower horizontal highway 208. The one-sided printed media sheet is then transported along the lower horizontal highway 218 to printing module 204 inverter decision gate 220. Printing module 204 inverter decision gate 220 routes the one-sided printed media sheet into the inverter. The inverter reverses the direction of the sheet and routes the sheet to the lower horizontal highway 224 in an inverted state. The inverted print media, printed on one side only, is then routed thru printing module 204 input decision gate 226 for printing performed by printing module 204. The media sheet then travels through the image transfer zone 226 where it is printed on side two and becomes a media sheet with print on both sides. The printed media sheet then travels along the path 228 indicated to reach the lower horizontal highway. The double sided print media sheet is then transported along the lower horizontal highway 208 to the finishing module 230.

Figure 7:
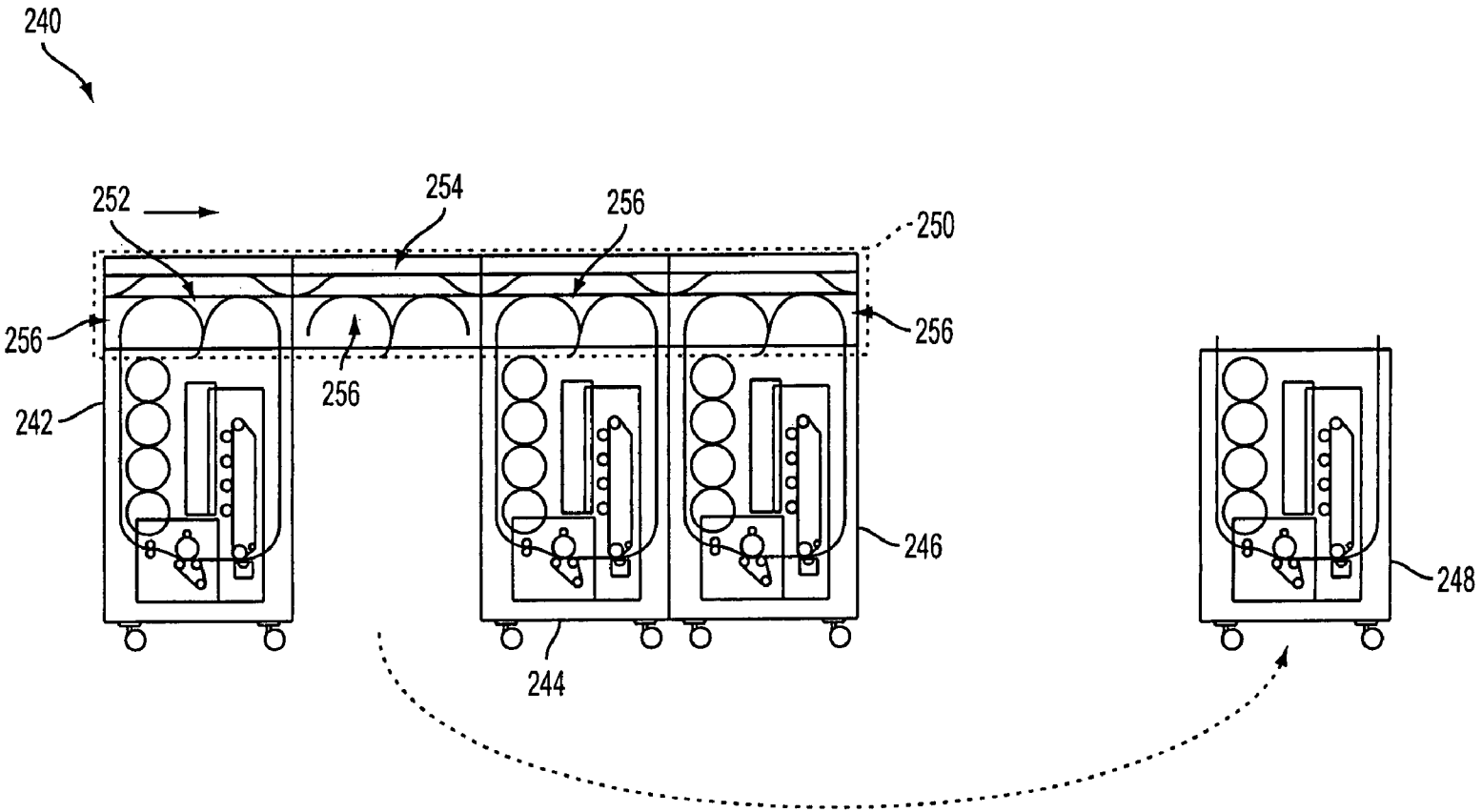
FIG. 7 is a sectional view showing an arrangement of printing modules according to an embodiment.

Referring to FIG. 7, illustrated is an example of a printing system 240 which employs a modular architecture including four printing modules 242, 244, 246 and 248, and a separate horizontal frame structure 250 that includes a lower highway media path 252, an upper highway media path 254 and a plurality of integrated inverters 256 within the horizontal frame structure 250. In addition, this printing system 240 can include an attached feeder module (not shown) and a finisher module (not shown) interfaced at the ends of the horizontal highway frame structure.

As illustrated, each printing module 242, 244, 246 and 248, can be removed from the printing system 240 for service or other use without preventing the remaining printer modules and highway structure from functioning. The printing module 248 removed from the printing system illustrated in FIG. 7, does not include an inverter 256. However, alternate embodiments of the printing system disclosed can include detachable printing modules with inverters fixed to the printing modules whereby removal of a printing module includes removing the inverter without preventing the remaining printing modules and highway structure from functioning.

Figure 8:
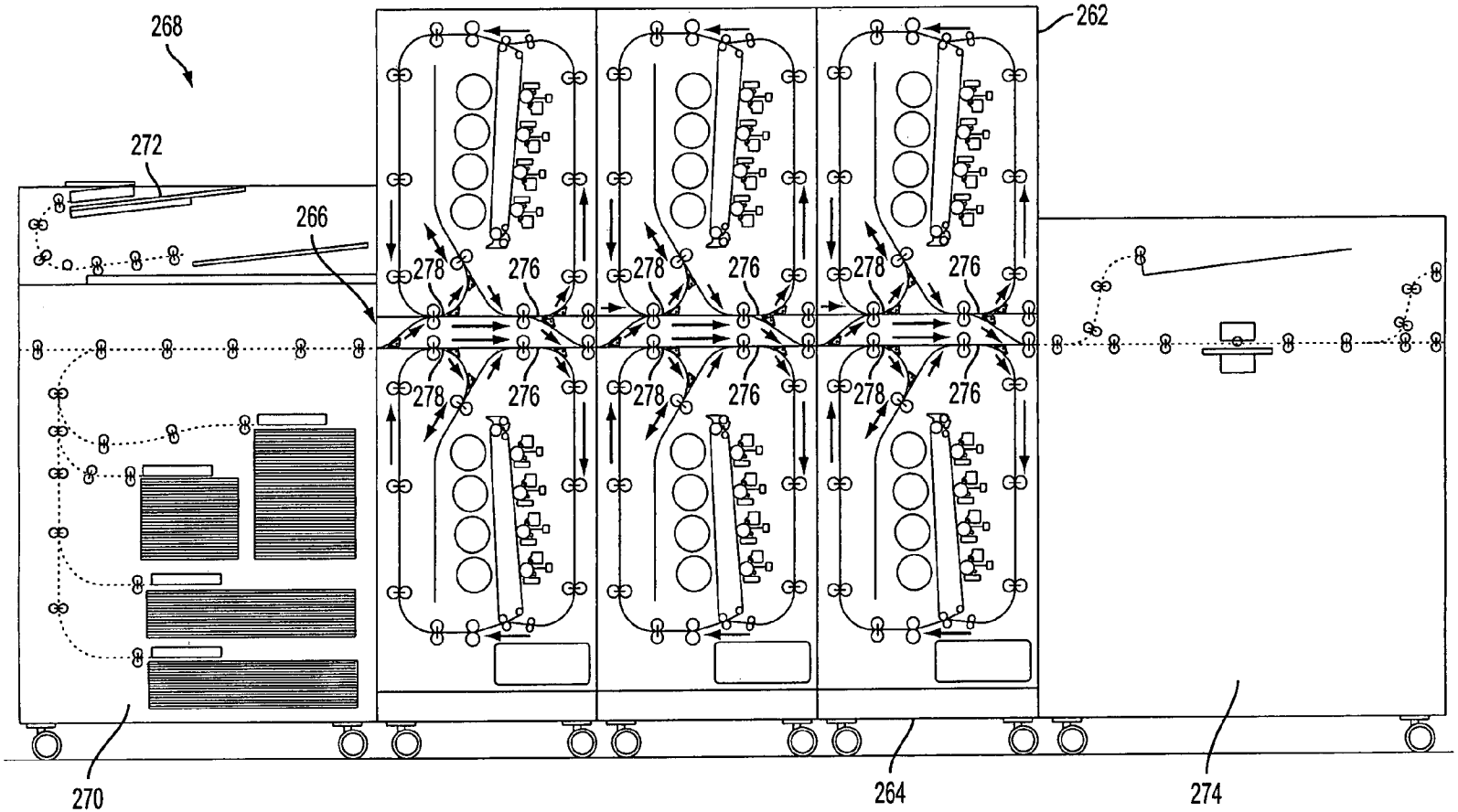
FIG. 8 is a sectional view showing an arrangement of printing modules according to an embodiment.

The modular architecture of FIG. 3 can be further extended as shown in FIG. 8. In this figure, two arrays, 262 and 264, of substantially horizontally aligned printing modules are linked together by a common set of horizontal highway transports 266. In addition, this printing system 268 can be integrated with a media feed source 270, a document scanner 272, and a finishing/stacking portion 274. Media transport is by way of two substantially horizontal highways, similar to those described in FIG. 3. As illustrated in FIG. 8, there is both a lower printing module array 264 and an upper printing module array 262. The upper array 262 printing modules and lower array 264 printing modules are positioned such that the media entrance path to each printing module, which includes decision gates 276, is positioned downstream of the flow of media on the lower or upper highways. As described above, with reference to FIGS. 1-7, this orientation of the printing module's media entrance path 276 relative to the printing module's media exit path 278 provides two pass printing on a media sheet via the same printing module in a relatively short distance. In addition, internal pass duplex printing can be accomplished with an inverter positioned between the entrance and exit marking paths of each printing module as described above with reference to FIGS. 1-7. An inverter may be integrated within the printing modules, external to the highway structure, or integrated within the highway structure. The integration of the upper array 262 and lower array 264 to the horizontal highway structure allows sheets to be routed from a lower printing module to an upper printing module. Such a configuration, as illustrated in FIG. 8, allows for a very compact footprint while retaining the previously described advantages of the modular architecture.

The modular architecture of the printing systems described above employ at least two printing modules with associated input/output media paths which can be substantially horizontally aligned utilizing supporting frames to form a basic configuration module with two printing modules. The modular architecture can include additional printing modules which can be fastened together with the other printing modules in which the horizontal highway can be aligned to transport media to/from the printing modules. The system can include additional horizontal highways positioned above these printing modules. It is to be appreciated that the highways can move media at a faster transport speed than the internal printing module paper paths.

The modular media path architecture provides for a common interface and highway geometry which allows different printing modules with different internal media paths together in one system. The modular media path includes entrance and exit media paths which allow sheets from one printing module to be fed to another printing module, either in an inverted or in a non-inverted orientation. The modular media path can also involve an internal duplex loop within one printing module which is optionally provided so that duplex printing can continue even when one or more of the other printing modules are inoperative. The ability to operate printing modules while servicing one or more other printing modules improves system throughput and productivity.

The modular architecture enables a wide range of printing modules in the same system. As described above, the printing modules can involve a variety of types and processing speeds. The modular architecture provides redundancy for the printing system and alternate paths provide internal duplex loops for backup. The modular architecture can utilize a single media source on the input side and a single output finishing module on the output side. It is to be appreciated that a key advantage of the system is that it can achieve very high productivity, using marking processes in members that do not have to run at high speeds. This simplifies many subsystems such as fusing, and allows use of inexpensive printing modules. Although not shown, other versions of the modular architecture can include an additional number of printing modules.

The modular architecture enables single pass duplexing, multi-pass color processing, and redundant duplex loops which provide a shorter media path that maximizes reliability and duplex productivity. Furthermore, the modular architecture allows media sheets to be conveyed at high speeds through relatively short straight transports, providing a reliable system. In addition, the highways can be located along the top surface of the system for easy customer access.

The illustrated embodiments have been described with reference to the specific embodiments. Obviously, modifications and alterations will occur to others upon reading and understanding the preceding detailed description. It is intended that the illustrated embodiments be construed as including all such modifications and alterations insofar as they come within the scope of the appended claims or the equivalents thereof.

The invention claimed is:

1. An integrated printing system comprising:

at least two substantially horizontally aligned printing modules including a first printing module and a second printing module, the first printing module including an entrance media path and an exit media path, and the second printing module including an entrance media path and an exit media path; and at least one interface media transport including at least one substantially horizontal media transport path which transports media to said printing modules in a direction that passes the first printing module exit media path before passing the first printing module entrance media path, and passes the second printing module exit media path before passing the second printing module entrance media path.

2. The integrated printing system of claim 1, wherein the substantially horizontal media transport paths includes two or more substantially horizontal media transport paths positioned as an upper and lower horizontal media transport paths.

3. The integrated printing system of claim 2, wherein the lower horizontal media transport path is linked with the entrance media path and the exit media path of each of the printing modules, and the upper horizontal media transport path is linked with the lower horizontal media transport path to transport media from the upper horizontal media transport path to the lower horizontal media transport path and transport media from the lower horizontal media transport path to the upper horizontal media transport path.

4. The integrated printing system of claim 3, further comprising:

at least one media feed source; and at least one media finishing portion, wherein the interface media transport extends from the media feed source to the media finishing portion.

5. The integrated printing system of claim 4, further comprising:

decision gates controlling the interface media transport to transport media from the upper horizontal media transport path to the lower horizontal media transport path and transport media from the lower horizontal media transport path to the upper horizontal media transport path.

6. The integrated printing system of claim 5, further comprising:

decision gates controlling the transport of media from the lower horizontal media transport path to the printing modules.

7. The integrated printing system of claim 6, further comprising:

a decision gate controlling the entrance media path.

8. The integrated printing system of claim 1, wherein the printing modules include at least one inverter to invert media for duplex printing, the inverter connected to the substantially horizontal media transport path.

9. The integrated printing system of claim 8, wherein the inverter is positioned between the entrance media path and the exit media path associated with the first printing module.

10. The integrated printing system of claim 1, wherein the interface media transport includes at least one inverter to invert media for duplex printing, the inverter connected to the substantially horizontal media transport path.

11. The integrated printing system of claim 10, wherein the inverter is positioned between the entrance media path and the exit media path associated with the first printing module.

12. The integrated printing system of claim 2, wherein the lower horizontal media transport path is linked with the entrance media path and the exit media path of at least one of the printing modules, and the lower horizontal media transport path transports media in a direction that passes the exit media path before passing the entrance media path associated with the first printing module, and the upper horizontal media transport path is linked with the lower horizontal media transport path to transport media from the upper horizontal media transport path to the lower horizontal media transport path and transport media from the lower horizontal media transport path to the upper horizontal media transport path.

13. The integrated printing system of claim 12, further comprising:

at least one media feed source; and at least one media finishing portion, wherein the interface media transport extends from the media feed source to the media finishing portion.

* * * * *